US005383790A

United States Patent [19]

Kerek et al.

[11] Patent Number: 5,383,790

[45] Date of Patent: Jan. 24, 1995

[54] CONNECTOR WITH FLOATING SELF-ALIGNMENT AND ZERO IMPULSE SEPARATION MECHANISMS

[75] Inventors: Leslie Kerek, Los Angeles; Edward Rudoy, Woodland Hills, both of Calif.

[73] Assignee: G & H Technology, Inc., Camarillo, Calif.

[21] Appl. No.: 154,514

[22] Filed: Nov. 19, 1993

[51] Int. Cl.[6] ..... H01R 13/029; H01R 13/635

[52] U.S. Cl. ..... 439/248; 439/152

[58] Field of Search ..... 439/152, 247, 248

[56] References Cited

U.S. PATENT DOCUMENTS 2,993,187 7/1961 Bisbing et al. ..... 439/248 X 4,286,834 9/1981 Goodman et al. ..... 439/152 X

*Primary Examiner*—Eugene F. Desmond

*Attorney, Agent, or Firm*—Thomas I. Rozsa; Tony D. Chen

[57] ABSTRACT

The present invention is a connector assembly mounted between two panels which are movable relative to each other. It includes a connector plug having a plug shell with an exterior flange, and a connector receptacle shell engageable with the plug shell and having an exterior receptacle flange. The receptacle flange has a multiplicity of openings each having an interior conical surface and an interior cylindrical surface. A multiplicity of self-alignment mounting assemblies is provided for mounting the receptacle flange to one panel. Each self-alignment mounting assembly includes an eyelet placed through the flange opening and mounted to the panel. The eyelet has an exterior conical surface engageable with the interior conical surface of each flange opening, and an exterior cylindrical surface with a reduced dimension for maintaining a clearance between the exterior cylindrical surface of the eyelet and the interior cylindrical surface of the flange opening. Each self-alignment mounting assembly further includes an alignment spring for providing cushioning between the receptacle flange and the eyelet. The connector assembly further includes an adjustable ejection assembly assembled in the receptacle shell for applying an ejection force on the plug shell. The multiplicity of self-alignment mounting assemblies provide proper connection between the connector plug and the connector receptacle during misaligned engagement or separation where the plug shell and the receptacle shell are linearly or angularly shifted relative to each other, and the adjustable ejection assembly provides proper ejection force between the plug shell and the receptacle shell for minimum impulse separation.

20 Claims, 3 Drawing Sheets

FIG. 8
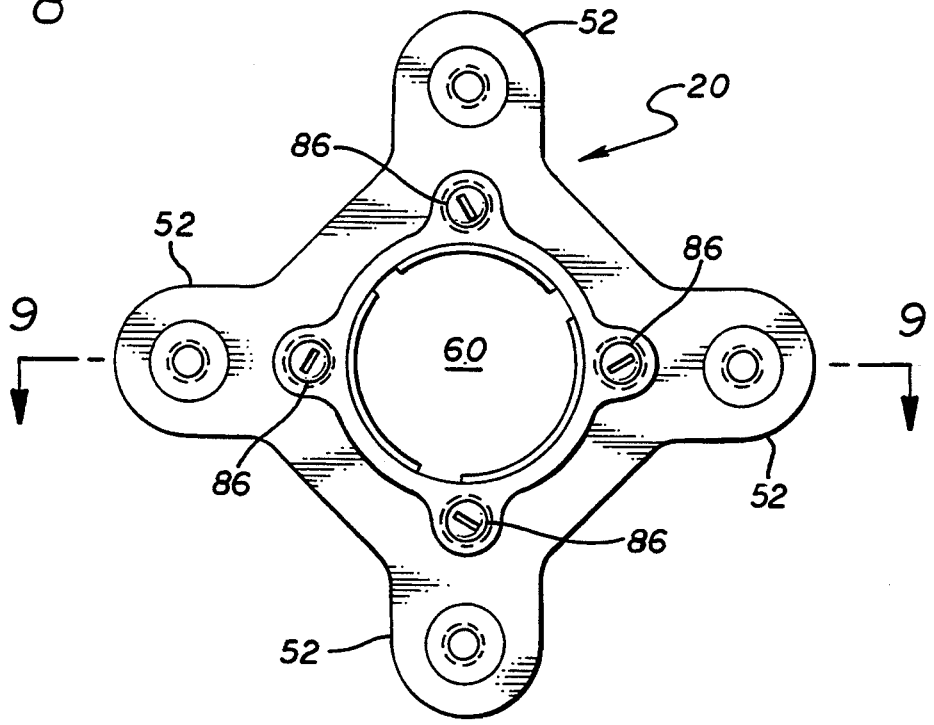
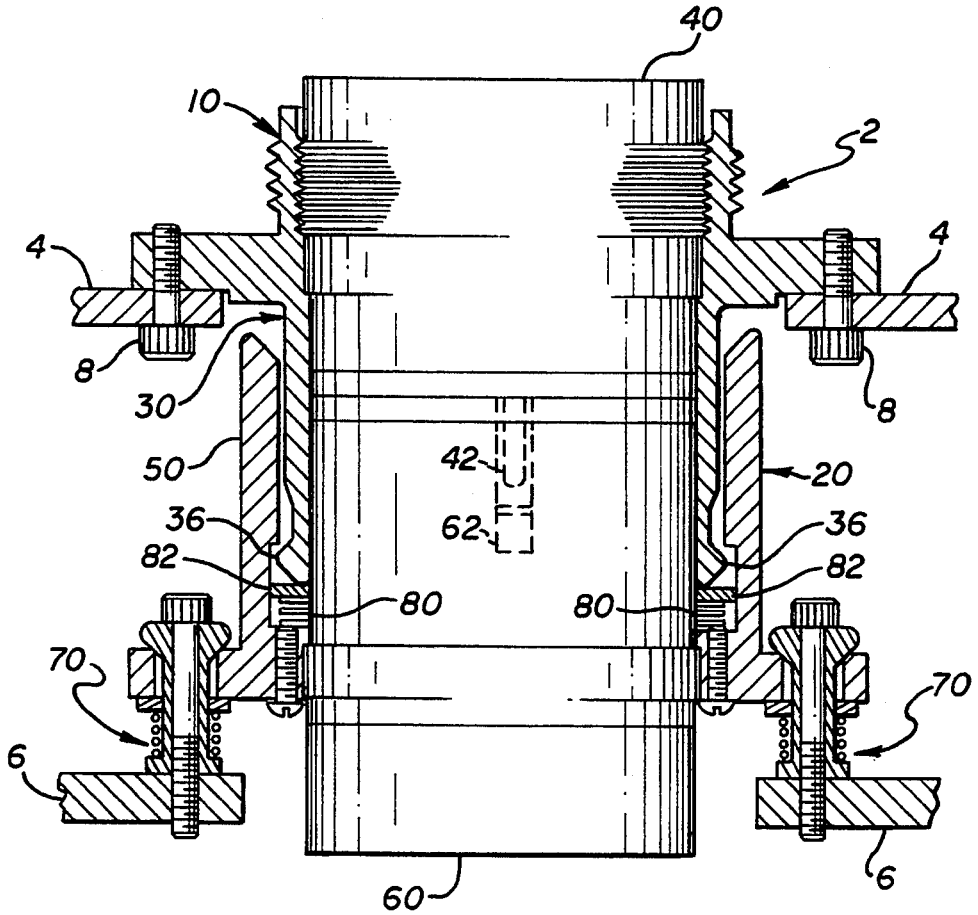
FIG. 9

CONNECTOR WITH FLOATING SELF-ALIGNMENT AND ZERO IMPULSE SEPARATION MECHANISMS

BACKGROUND OF THE INVENTION

1. Field of the Invention

The present invention relates to the field of separable electrical connectors. More particularly, the present invention relates to the field of separable electrical connectors utilized in space technology applications.

2. Description of the Prior Art

The following nine (9) prior art patents are believed to be pertinent to the field of the present invention:

1. U.S. Pat. No. 2,871,457 issued to Jencks et al. on Jan. 27, 1959 for "Mounting For Electronic Components" (hereafter "the Jencks Patent").

2. U.S. Pat. No. 3,088,089 issued to Gregoire on Apr. 30, 1963 for "Electrical Connector" (hereafter "the Gregoire Patent").

3. U.S. Pat. No. 3,094,364 issued to Lingg on Jun. 18, 1963 for "Connector Mounting" (hereafter "the Lingg Patent").

4. U.S. Pat. No. 3,951,500 issued to Anderson on Apr. 20, 1976 for "Circular Rack And Paner" (hereafter "the Anderson Patent").

5. U.S. Pat. No. 4,580,862 issued to Johnson on Apr. 8, 1986 for "Floating Coaxial Connector" (hereafter "the Johnson Patent").

6. U.S. Pat. No. 4,697,859 issued to Fisher, Jr. on Oct. 6, 1987 for "Floating Coaxial Connector" (hereafter "the '859 Fisher Patent").

7. U.S. Pat. No. 4,789,351 issued to Fisher, Jr. el al. on Dec. 6, 1988 for "Blind Mating Connector With Snap Ring Insertion" (hereafter "the '351 Fisher Patent").

8. U.S. Pat. No. 4,815,986 issued to Dholoo on Mar. 28, 1989 for "Self-Aligning Blind Mate Connector" (hereafter "the Dholoo Patent").

9. U.S. Pat. No. 4,909,748 issued to Kozono et al. on Mar. 20, 1990 for "Movable Connector" (hereafter "the Kozono Patent").

The Jencks Patent discloses a mounting for electronic equipment. The Jencks Patent mounting apparatus is a self ejecting electrical equipment rack assembly. It includes a housing which is adapted to contain and releasably support therein a plurality Of electrical units. It has a floating arrangement which is accomplished by compression springs between the plates and the compression springs encircling the shanks of pins. The motion of the plate is limited by spring rings seated within a groove in the pins which abut the lower surface of the plate. The motion of the unit into the housing effects the coupling of the plugs and receptacles and a simultaneous slight amount of compression in the springs. At the point of full compression, the face plate abuts upper angle members, and at which time slotted fasteners may be turned to lock the unit in an assembled position. Upon release of the fasteners, the expansion of the springs serves to eject the electrical unit a slight distance out of the housing and allows an operator to grasp the unit. However, the compression springs cannot be adjusted for separation spring force and are mounted between the plates.

The Gregoire Patent discloses an electrical connector. The Gregoire Patent electrical connector includes a first connector part rigidly mounted on a first panel, and a second connector part retractably mounted on a second panel. The second connector part is constantly urged by a resilient member.

The Lingg Patent discloses a connector mounting. The connector mounting has a cylindrical guide member for facilitating the coupling of the connector members. The cylindrical guide member is bound by a large coil spring which is in turn disposed within a cylindrical housing.

The Anderson Patent discloses a circular rack and panel connector. It includes a connector receptacle and a connector plug with one connector mounted on a unit of electrical equipment and the other connector mounted on a panel. In order to facilitate the connection of the plug and receptacle connectors and to prevent damage to them, a pair of guide pins are disposed in a horizontal plane on radially opposite outer sides of the connector shell of the rack mounted connector with the guide pins extending beyond the mating ends of the connector shell. The guide pins are mounted on a flange which is attached to the connector shell. The guide pins engage guide openings in a mounting flange on the other connector. The guide pins and guide openings are tapered at their forward ends to accommodate a small amount of angular misalignment of the guide pins during insertion into the guide openings. There is also a coil spring which aligns with the threaded openings, placing the spring directly behind and radially coincident with each of the guide pins so that forces applied to the guide pins upon connection of the members will be transmitted directly to the spring thereby minimizing tilting of the flange if the forces applied to the opposite guide pins are equal.

The Johnson Patent discloses a floating coaxial connector. The coaxial connector includes a plug member and a receptacle member. The plug member is mounted to a fixed panel, and the receptacle member is mounted to a moveable panel. A coil spring is utilized in the receptacle member so that the body of the receptacle member can move coaxially.

The '859 Fisher Patent also discloses a floating coaxial connector which utilizes a coil spring to support the receptacle member.

The '351 Fisher Patent discloses a blind mating connector with a snap ring insertion. The '351 Fisher Patent provides a connector comprising plug and jack halves which are intermated to join a transmission cable. Each of the halves includes a snap ring assembly and mechanism which allows each of the halves to be mounted into a housing or panel.

The Dholoo Patent discloses a self-aligning blind mate connector. The Dholoo Patent provides a co-axial connector comprising two independently-floating halves. As connector members are moved laterally into engagement, the alignment insert end of the body member will be guided by a tapered guide hole in the end of the body member to properly orient the plug member and socket member. Body members of connector halves will be radially deflected to allow for proper engagement of the plug within the socket. Metal bellows members allow for axial and radial deflection while maintaining electrical continuity.

The Kozono Patent discloses a movable connector. It includes four annular spring members integrally formed around the male housing at a rear portion.

In space technology applications, there are certain special requirements imposed on the electrical connectors. For example, in satellite applications, one of the plug or receptacle members of a connector is often mounted to the panel of a satellite, and the other one of the plug or receptacle members of the connector is often mounted to the panel of a launch station. When the satellite is engaged to the launch station, the plug and the receptacle members of the connector are often shifted linearly and/or angularly relative to each other, and the mounting of the connector must be able to perform self-alignment to ensure proper engagement of the plug and receptacle members of the connector. When satellites are launched, the separation of the plug and receptacle members of the connector must produce no excessive forces, because any interference from the disengagement of the plug and receptacle members will affect the launch angle of the satellite, which will in turn prevent proper orbiting of the satellite.

Therefore, it is desirable to have a new connector assembly specially designed and constructed to ensure proper self-alignment during coupling and minimum impulse during separation.

SUMMARY OF THE INVENTION

The present invention is an electrical connector assembly with floating self-alignment and zero impulse separation mechanisms.

The present invention is a connector assembly which provides a self-alignment feature with a non-binding and zero impulse separation mechanism. The present invention connector assembly requires no external force to separate the two mating halves of the connectors and will separate with constant velocity. The separation velocity can be customized for each set of connectors to meet specific requirements.

The present invention consists of two major components, including a connector plug and a connector receptacle. The connector plug includes a connector shell and an insert assembly with male or female contacts. The connector plug can be hard mounted or mounted through a self-aligning eyelet on a panel. The connector receptacle includes a connector shell, an insert assembly with male or female contacts and an adjustable ejecting mechanism. The connector receptacle is attached to the panel through the self-aligning eyelet which is preloaded with compression springs.

During misaligned engagement where the center lines of the connector plug and the connector receptacle are shifted linearly and/or angularly relative to each other, the front end of the connector shell of the connector plug will shift the connector shell of the connector receptacle as it moves into the front end of the connector shell of the connector receptacle. This shifting motion is transferred through a flange to the compression spring, and compresses and disengages the conical surface of the eyelet from the surface of the flange. As a result, a clearance occurs between the guide openings of the flange and the cylindrical portion of the eyelets to allow free angular and linear movement of the connector receptacle relative to the connector plug to facilitate proper engagement.

After the two connector halves are aligned by the self-alignment feature during the initial phase of engagement, the front end of the connector plug continues to travel into the cavity of the connector receptacle until it engages with the snap ring. Further travel of the front end of the connector plug compresses the ejector springs thereby storing energy for separation. The energy stored for separation is adjusted just large enough to overcome both the retention force of all the contacts and the friction between both of the connector shells. Since the contact retention forces and friction between connector plug and connector receptacle will vary from connector to connector, adjustment for the separation spring force is provided by adjustment screws. By tightening or loosening the adjustment screws, the preload of the ejector springs and consequently the separation energy can be adjusted to assure zero integrated impulse during separation.

Generally described, the present invention is a connector assembly mounted between a first panel and a second panel, where the first and second panels are movable relative to each other and each has a connector opening. The connector assembly comprises a connector plug having a cylindrical plug shell, and a connector receptacle having a cylindrical receptacle shell. The plug shell has an exterior plug flange for mounting the plug shell to the first panel, an interior chamber for housing a male connector with at least one pin contact, and a proximal end with a rounded circular lip. The plug shell is mounted to the first panel such that the connector plug extends through the connector opening of the first panel. The receptacle shell has an exterior receptacle flange, an interior chamber for housing a female connector and forming a tubular cavity between the receptacle shell and the female connector for receiving the proximal end of the plug shell, and a proximal end with a circular ramp surface. The female connector has at least one socket contact engageable with the at least one pin contact of the male connector. The receptacle flange has a multiplicity of openings symmetrically positioned around the receptacle shell, each opening having an interior conical surface and an interior cylindrical surface.

The present invention connector assembly also comprises a multiplicity of self-alignment mounting assemblies symmetrically positioned around the receptacle shell for mounting the receptacle flange to the second panel. Each self-alignment mounting assembly includes an eyelet placed through each flange opening, where the eyelet has an exterior conical surface engageable with the interior conical surface of each flange opening, and an exterior cylindrical surface with a reduced dimension for maintaining a tubular clearance between the exterior cylindrical surface of the eyelet and the interior cylindrical surface of the flange opening. Each self-alignment mounting assembly further includes an alignment spring for providing cushioning between the receptacle flange and the eyelet. The eyelet of each self-alignment mounting assembly is mounted to the second panel such that the connector receptacle extends through the connector opening of the second panel. The multiplicity of self-alignment mounting assemblies provide proper connection between the connector plug and the connector receptacle during misaligned engagement or separation where the plug shell and the receptacle shell are linearly or angularly shifted relative to each other.

The present invention further comprises an adjustable ejection assembly disposed within the tubular cavity of the receptacle shell. The adjustable ejection assembly includes a circular snap ring engageable with the proximal end of the plug shell, a multiplicity of ejection springs symmetrically positioned for biasing the snap ring, and means for individually adjusting a pre-load of each ejection spring to apply a balanced ejection force on the plug shell. The adjustable ejection assembly provides proper ejection force between the plug shell and the receptacle shell for minimum impulse separation.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 8 is a bottom view of the connector receptacle of the present invention connector assembly.

FIG. 9 is a cross-sectional view of the present invention connector assembly, showing the connector plug and connector receptacle connected.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
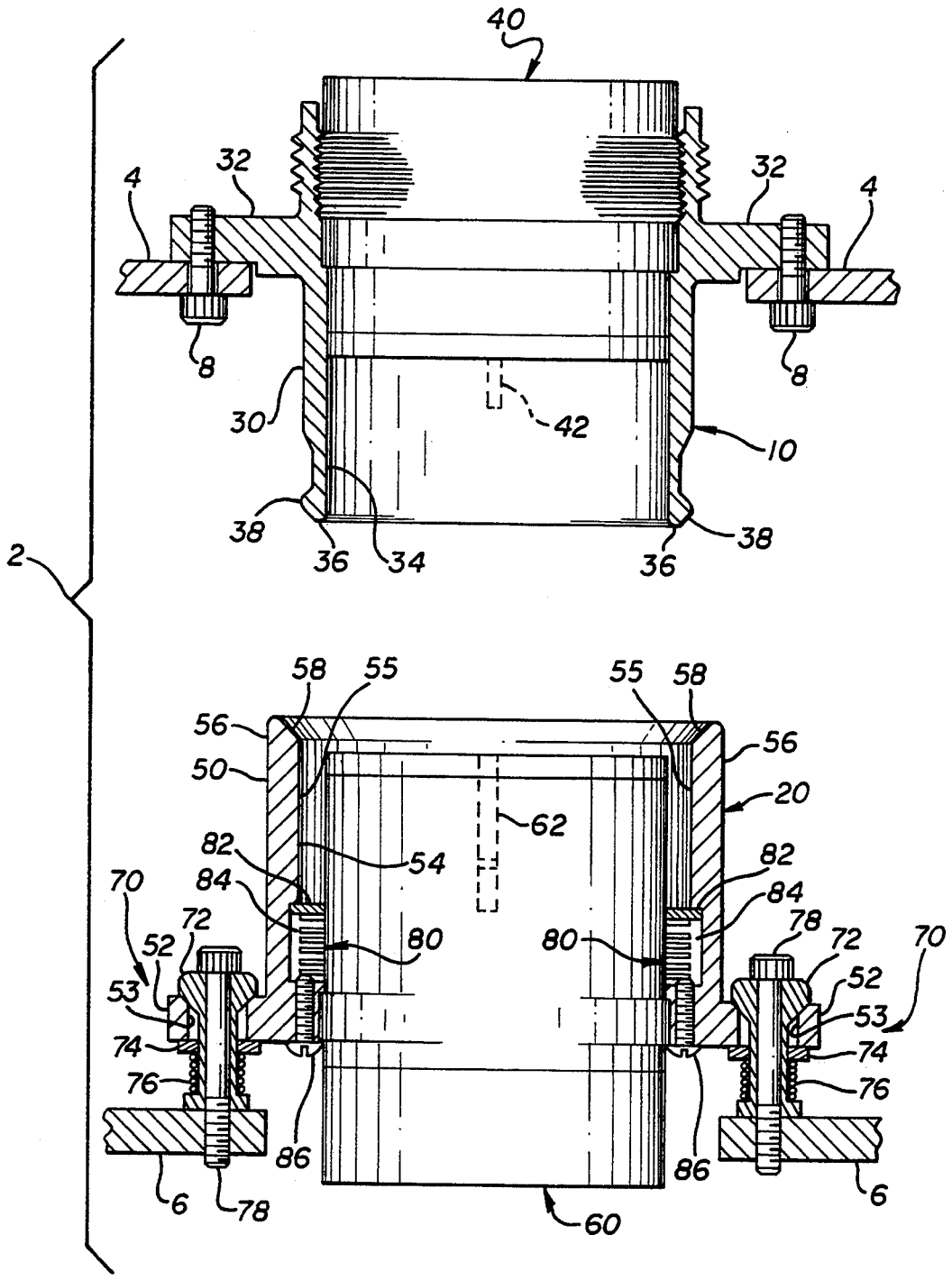
FIG. 1 is a cross-sectional view of the present invention connector assembly, showing the connector plug and connector receptacle before they are connected.

Referring to FIG. 1, there is shown a cross-sectional view of the present invention zero integrated impulse connector assembly 2 mounted between a first panel 4 and a second panel 6, where the first and second panels 4 and 6 are movable relative to each other. The connector assembly 2 includes a connector plug 10 and a connector receptacle 20.

The connector plug 10 has a cylindrical plug shell 30. The plug shell has an exterior plug flange 32 for mounting the plug shell 20 to the first panel. The plug shell 30 also has an interior chamber 34 for housing a male connector 40 which has at least one pin contact 42. The plug shell has a proximal end 36 with a rounded circular lip 38. The connector plug 10 is mounted to the first panel 4 by mounting the plug flange 32 to the first panel 4 with mounting bolts 8, such that the connector plug 10 is extending through a connector opening of the first panel 4.

The connector receptacle 20 has a cylindrical receptacle shell 50. The receptacle shell 50 has an exterior receptacle flange 52. Referring to FIGS. 1 and 8, receptacle flange 52 has a multiplicity of openings 53 symmetrically positioned around the receptacle shell 50. Each flange opening 53 has an interior conical surface 94 and an interior cylindrical surface 98 (see FIG. 2).

Referring back to FIG. 1, the receptacle shell also has an interior chamber 54 for housing a female connector 60 and forming a tubular cavity 55 between the receptacle shell 50 and the female connector 60 for receiving the proximal end 36 of the plug shell 30. The female connector 60 has at least one socket contact 62 which is engageable with the at least one pin contact 42 of the male connector 40. The receptacle shell 50 further has a proximal end 56 with a circular ramp surface 58. The rounded lip 38 at the proximal end 36 of the plug shell and the ramp surface 58 at the proximal end 56 of the receptacle shell 50 are designed to facilitate easy engagement of the plug shell 30 and the receptacle shell 50.

Figure 2:
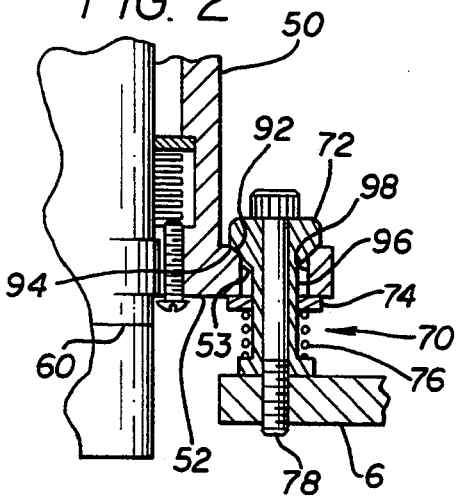
FIG. 2 is a partial cross-sectional view showing the self-alignment feature of the present invention connector assembly, as the connector plug and connector receptacle are properly aligned.

A multiplicity of self-alignment mounting assemblies 70 are symmetrically positioned around the receptacle shell 50 for mounting the connector receptacle 20 to the second panel 6 by mounting the receptacle flange 52 to the second panel 6. Each self-alignment mounting assembly 70 includes an eyelet 72 placed through each flange opening 53. Referring to FIG. 2, the eyelet 72 has an exterior conical surface 92 which is engageable with the interior conical surface 94 of each flange opening 53, and an exterior cylindrical surface 96 with a reduced dimension for maintaining a tubular clearance between the exterior cylindrical surface 96 of the eyelet 72 and the interior cylindrical surface 98 of the flange opening 53.

Each self-alignment mounting assembly 70 further includes an alignment spring 76 for providing cushioning between the receptacle flange 52 and the eyelet 72, and a washer 74 placed between the alignment spring 76 and the receptacle flange 52. The eyelet 72 of each self-alignment mounting assembly 70 is mounted to the second panel 6 by mounting bolt 78, such that the connector receptacle 20 is extending through the connector opening of the second panel 6.

An adjustable ejection assembly 80 is disposed within the tubular cavity 55 of the receptacle shell 50. The adjustable ejection assembly 80 includes a circular snap ring 82 which is engageable with the proximal end 36 of the plug shell 30 when it is received within the tubular cavity 55 of the receptacle shell 50, as shown in FIG. 9.

Referring to FIG. 1 and FIG. 8, adjustable ejection assembly 80 further includes a multiplicity of ejection springs 84 which are symmetrically positioned around the interior chamber 54 of the receptacle shell 50 for biasing the snap ring 82, and a multiplicity of adjusting screws 86 respectively engaged with the ejection springs 84 for individually adjusting a pre-load of each ejection spring 84, to apply a balanced ejection force on the plug shell 30.

One of the advantageous features of the present invention is that the multiplicity of self-alignment mounting assemblies 70 provide proper connection between the connector plug 10 and the connector receptacle 20 during misaligned engagement or separation where the plug shell 30 and the receptacle shell 50 are linearly or angularly shifted relative to each other.

As shown in FIG. 2, when connector plug 10 and connector receptacle 20 are properly aligned, the interior conical surface 98 of flange opening 53 is properly engaged with the exterior conical surface 96 of eyelet 72, and a clearance is maintained between the interior cylindrical surface 94 of flange opening 53 and the exterior cylindrical surface 92 of eyelet 72.

Figure 3:
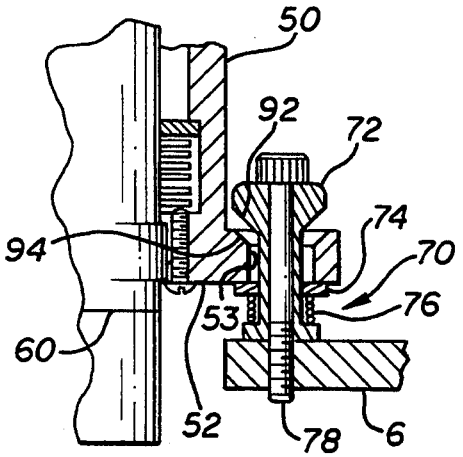
FIG. 3 is a partial cross-sectional view showing the self-alignment feature of the present invention connector assembly, as the connector plug and connector receptacle are shifted longitudinally relative to each other.

However, as shown in FIG. 3, when the connector plug 10 and connector receptacle 20 are shifted linearly along the longitudinal direction relative to each other, the interior conical surface 94 of flange opening 53 and the exterior conical surface 92 of eyelet 72 are disengaged and the alignment spring 76 provides a cushioning between receptacle flange 52 and eyelet 72.

Figure 4:
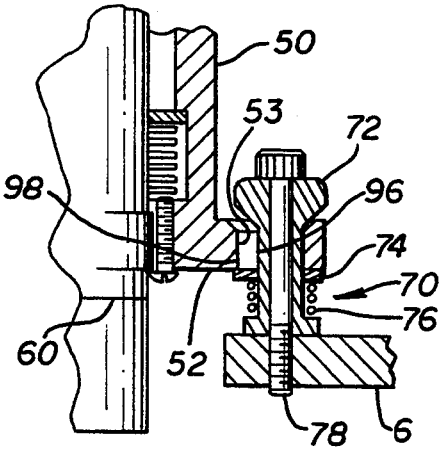
FIG. 4 is a partial cross-sectional view showing the self-alignment feature of the present invention connector assembly, as the connector plug and connector receptacle are shifted transversely relative to each other.

Moreover, as shown in FIG. 4, when the connector plug 10 and connector receptacle 20 are shifted linearly along the transverse direction relative to each other, the tubular space between the interior cylindrical surface 98 of flange opening 53 and the exterior cylindrical surface 96 of eyelet 72 provides the necessary clearance for the transverse shifting between receptacle flange 52 and eyelet 72.

Figure 5:
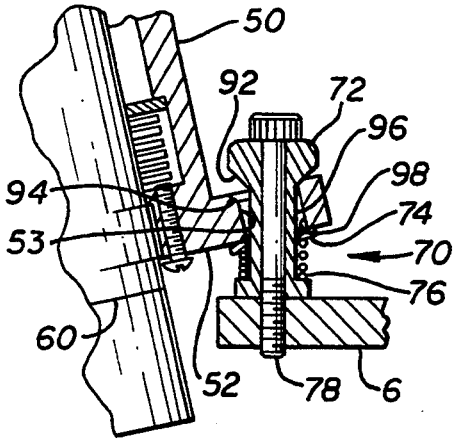
FIG. 5 is a partial cross-sectional view showing the self-alignment feature of the present invention connector assembly, as the connector plug and connector receptacle are shifted angularly relative to each other.

In addition, as shown in FIG. 5, when the connector plug 10 and connector receptacle 20 are shifted angularly relative to each other, the tubular space between the cylindrical interior surface 98 of flange opening 53 and the exterior surface 96 of eyelet 72, and the configuration of conical interior surface 94 of flange opening 53 and the exterior surface 92 of eyelet 72, provide the necessary clearance for the angular shifting between receptacle flange 52 and eyelet 72.

Figure 6:
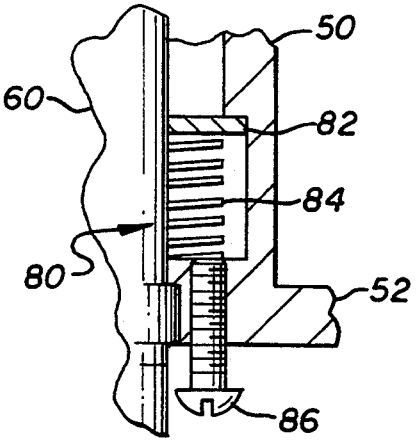
FIG. 6 is a partial cross-sectional view showing the adjustable ejection mechanism of the present invention connector assembly, where a minimum pre-load is applied to the ejection spring.
Figure 7:
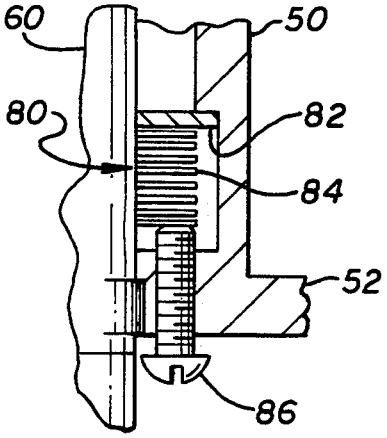
FIG. 7 is a partial cross-sectional view showing the adjustable ejection mechanism of the present invention connector assembly, where a maximum pre-load is applied to the ejection spring.

Another one of the advantageous features of the present invention is that the adjustable ejection assembly provides proper ejection force between the plug shell and the receptacle shell for minimum impulse separation. As shown in FIG. 6, the adjusting screw 86 can be threaded all the way out to apply zero pre-load on the ejection spring 84, which in turn applies a minimum ejection force on the snap ring 82. However, the adjusting screw 86 can be threaded inwardly to increase the pre-load on the ejection spring 84, which in turn increases the ejection force on the snap ring 82. In addition, after electrical engagement of connector plug 10 and connector receptacle 20, the compressed ejection springs 84 will provide an axial force to compress the interfacial seal. This feature makes it possible to fine tune the ejection force to be applied on the snap ring 82 to effectuate the minimum impulse separation of the connector plug 10 and connector receptacle 20.

It is noted that the present invention may have many alternative embodiments, including: (a) the connector plug may house female socket contacts, and the connector receptacle may house male pin contacts; (b) the connector plug may be mounted to the second panel, and the connector receptacle may be mounted to the first panel; (c) both the connector plug and the connector receptacle may be mounted by the self-aligned mounting assemblies; (d) the number of self-aligned mounting assemblies may vary, preferably four (4) self-aligned mounting assemblies are used and spaced ninety degrees (90°) apart; (e) the adjustable ejection assembly may be assembled to the connector plug and made engageable with the receptacle shell of the connector receptacle; and (f) the number of adjustable springs used in the adjustable ejection assembly may vary, preferably four (4) adjustable springs are used and spaced ninety degrees (90°) apart, or six (6) adjustable springs are used and spaced sixty degrees (60°) apart.

Defined in detail, the present invention is a connector assembly mounted between a first panel and a second panel, where the first and second panels are movable relative to each other and each has a connector opening, the connector assembly comprising: (a) a connector plug having a cylindrical plug shell, the plug shell having an exterior plug flange for mounting the plug shell to the first panel, an interior chamber for housing a male connector with at least one pin contact, and a proximal end with a rounded circular lip; (b) means for mounting the plug flange to the first panel such that the connector plug extends through the connector opening of the first panel; (c) a connector receptacle having a cylindrical receptacle shell, the receptacle shell having an exterior receptacle flange, an interior chamber for housing a female connector and forming a tubular cavity between the receptacle shell and the female connector for receiving the proximal end of the plug shell, and a proximal end with a circular ramp surface, the female connector having at least one socket contact engageable with the at least one pin contact of the male connector; (d) the receptacle flange having a multiplicity of openings symmetrically positioned around the receptacle shell, each opening having an interior conical surface and an interior cylindrical surface; (e) a multiplicity of self-alignment mounting assemblies symmetrically positioned around the receptacle shell for mounting the receptacle flange to the second panel; (f) each self-alignment mounting assemblies including an eyelet placed through each flange opening, the eyelet having an exterior conical surface engageable with the interior conical surface of each flange opening, and an exterior cylindrical surface with a reduced dimension for maintaining a tubular clearance between the exterior cylindrical surface of the eyelet and the interior cylindrical surface of the flange opening; (g) each self-alignment mounting assembly further including an alignment spring for providing cushioning between the receptacle flange and the eyelet; (h) means for mounting the eyelet of each self-alignment mounting assembly to the second panel such that the connector receptacle extends through the connector opening of the second panel; and (i) an adjustable ejection assembly disposed within the tubular cavity of the receptacle shell and including a circular snap ring engageable with the proximal end of the plug shell, a multiplicity of ejection springs symmetrically positioned for biasing the snap ring, and means for individually adjusting a pre-load of each ejection spring to apply a balanced ejection force on the plug shell; (j) whereby the multiplicity of self-alignment mounting assemblies provide proper connection between the connector plug and the connector receptacle during misaligned engagement or separation where the plug shell and the receptacle shell are linearly or angularly shifted relative to each other, and the adjustable ejection assembly provides proper ejection force between the plug shell and the receptacle shell for minimum impulse separation.

Defined broadly, the present invention is a connector assembly mounted between two panels which are movable relative to each other, the connector assembly comprising: (a) a connector plug having a plug shell, the plug shell having an exterior plug flange; (b) a connector receptacle having a receptacle shell, the receptacle shell engageable with the plug shell and having an exterior receptacle flange; (c) at least one of the plug flange and the receptacle flange having a multiplicity of openings each having an interior conical surface and an interior cylindrical surface; (d) a multiplicity of self-alignment mounting assemblies for mounting the at least one of the plug flange and the receptacle flange to one of the two panels; (e) each self-alignment mounting assembly including an eyelet placed through each flange opening and mounted to the one of the two panels, the eyelet having an exterior conical surface engageable with the interior conical surface of each flange opening, and an exterior cylindrical surface with a reduced dimension for maintaining a clearance between the exterior cylindrical surface of the eyelet and the interior cylindrical surface of the flange opening; (f) each self-alignment mounting assembly further including an alignment spring for providing cushioning between the at least one of the plug flange and the receptacle flange and the eyelet; and (g) an adjustable ejection assembly assembled in one of the plug shell and receptacle shell for applying an ejection force on another one of the plug shell and receptacle shell; (h) whereby the multiplicity of self-alignment mounting assemblies provide proper connection between the connector plug and the connector receptacle during misaligned engagement or separation where the plug shell and the receptacle shell are linearly or angularly shifted relative to each other, and the adjustable ejection assembly provides proper ejection force between the plug shell and the receptacle shell for minimum impulse separation.

Defined more broadly, the present invention is a connector assembly mounted to at least one panel, comprising: (a) a connector plug having a plug shell, the plug shell having an exterior plug flange; (b) a connector receptacle having a receptacle shell, the receptacle shell engageable with the plug shell and having an exterior receptacle flange; (c) one of the plug flange and the receptacle flange having at least one opening with an interior configuration; and (d) at least one self-alignment mounting assembly including an eyelet placed through the at least one flange opening and mounted to the at least one panel, the eyelet having a portion with an exterior configuration similar to but smaller than the interior configuration of the at least one flange opening for maintaining a clearance therebetween; (e) whereby the at least one self-alignment mounting assembly provides a proper connection between the connector plug and the connector receptacle during misaligned engagement or separation where the plug shell and the receptacle shell are linearly or angularly shifted relative to each other.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modification in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A connector assembly mounted between a first panel and a second panel, where the first and second panels are movable relative to each other and each has a connector opening, the connector assembly comprising:

a. a connector plug having a cylindrical plug shell, the plug shell having an exterior plug flange for mounting the plug shell to said first panel, an interior chamber for housing a male connector with at least one pin contact, and a proximal end with a rounded circular lip;

b. means for mounting said plug flange to said first panel such that said connector plug extends through said connector opening of said first panel;

c. a connector receptacle having a cylindrical receptacle shell, the receptacle shell having an exterior receptacle flange, an interior chamber for housing a female connector and forming a tubular cavity between the receptacle shell and the female connector for receiving said proximal end of said plug shell, and a proximal end with a circular ramp surface, the female connector having at least one socket contact engageable with said at least one pin contact of said male connector;

d. said receptacle flange having a multiplicity of openings symmetrically positioned around said receptacle shell, each opening having an interior conical surface and an interior cylindrical surface;

e. a multiplicity of self-alignment mounting assemblies symmetrically positioned around said receptacle shell for mounting said receptacle flange to said second panel;

f. each said self-alignment mounting assembly including an eyelet placed through each said flange opening, the eyelet having an exterior conical surface engageable with said interior conical surface of each said flange opening, and an exterior cylindrical surface with a reduced dimension for maintaining a tubular clearance between the exterior cylindrical surface of the eyelet and said interior cylindrical surface of said flange opening;

g. each said self-alignment mounting assembly further including an alignment spring for providing cushioning between said receptacle flange and said eyelet;

h. means for mounting said eyelet of each said self-alignment mounting assembly to said second panel such that said connector receptacle extends through said connector opening of said second panel; and i. an adjustable ejection assembly disposed within said tubular cavity of said receptacle shell and including a circular snap ring engageable with said proximal end of said plug shell, a multiplicity of ejection springs symmetrically positioned for biasing said snap ring, and means for individually adjusting a pre-load of each ejection spring to apply a balanced ejection force on said plug shell;

j. whereby said multiplicity of self-alignment mounting assemblies provide proper connection between said connector plug and said connector receptacle during misaligned engagement or separation where said plug shell and said receptacle shell are linearly or angularly shifted relative to each other, and said adjustable ejection assembly provides proper ejection force between said plug shell and said receptacle shell for minimum impulse separation.

2. The invention as defined in claim 1 wherein said means for mounting said plug flange to said first panel include mounting bolts.

3. The invention as defined in claim 1 wherein each said self-alignment mounting assembly further includes a washer placed between said alignment spring and said receptacle flange.

4. The invention as defined in claim 1 wherein said means for mounting said eyelet of each said self-alignment mounting assembly to said second panel include mounting bolts.

5. The invention as defined in claim 1 wherein said means for individually adjusting a pre-load of each ejection spring to apply a balanced ejection force on said plug shell includes a multiplicity of screw bolts respectively engageable with each said ejection spring for applying pre-load on said ejection spring.

6. A connector assembly mounted between two panels which are movable relative to each other, the connector assembly comprising:

a. a connector plug having a plug shell, the plug shell having an exterior plug flange;

b. a connector receptacle having a receptacle shell, the receptacle shell engageable with said plug shell and having an exterior receptacle flange;

c. at least one of said plug flange and said receptacle flange having a multiplicity of openings each having an interior conical surface and an interior cylindrical surface;

d. a multiplicity of self-alignment mounting assemblies for mounting said at least one of said plug flange and said receptacle flange to one of said two panels;

e. each said self-alignment mounting assemblies including an eyelet placed through each said flange opening and mounted to said one of said two panels, the eyelet having an exterior conical surface engageable with said interior conical surface of each said flange opening, and an exterior cylindrical surface with a reduced dimension for maintaining a clearance between the exterior cylindrical surface of the eyelet and said interior cylindrical surface of said flange opening;

f. each said self-alignment mounting assemblies further including an alignment spring for providing cushioning between said at least one of said plug flange and said receptacle flange and said eyelet; and g. an adjustable ejection assembly assembled in one of said plug shell and receptacle shell for applying an ejection force on another one of said plug shell and receptacle shell;

h. whereby said multiplicity of self-alignment mounting assemblies provide proper connection between said connector plug and said connector receptacle during misaligned engagement or separation where said plug shell and said receptacle shell are linearly or angularly shifted relative to each other, and said adjustable ejection assembly provides proper ejection force between said plug shell and said receptacle shell for minimum impulse separation.

7. The invention as defined in claim 6 further comprising means for mounting another one of said plug flange and said receptacle shell to another one of said two panels.

8. The invention as defined in claim 7 wherein said means for mounting another one of said plug flange and said receptacle shell to another one of said two panels includes mounting bolts.

9. The invention as defined in claim 6 wherein each said self-alignment mounting assemblies further includes a washer placed between said alignment spring and said at least one of said plug flange and said receptacle flange.

10. The invention as defined in claim 6 wherein said eyelet of each of said self-alignment mounting assemblies is mounted to said one of said two panels by a mounting bolt.

11. The invention as defined in claim 6 wherein said adjustable ejection assembly is assembled in a tubular cavity of said one of said plug shell and receptacle shell.

12. The invention as defined in claim 11 wherein said adjustable ejection assembly includes a circular snap ring disposed within said tubular cavity, and a multiplicity of ejection springs for biasing said snap ring against said other one of said plug shell and receptacle shell.

13. The invention as defined in claim 12 wherein said adjustable ejection assembly further includes means for individually adjusting a pre-load on each of said ejection springs.

14. The invention as defined in claim 13 wherein said means for individually adjusting a pre-load on each said ejection spring includes a multiplicity of screw bolts respectively engageable with each of said ejection springs.

15. A connector assembly mounted to at least one panel, comprising:

a. a connector plug having a plug shell, the plug shell having an exterior plug flange;

b. a connector receptacle having a receptacle shell, the receptacle shell engageable with said plug shell and having an exterior receptacle flange;

c. one of said plug flange and said receptacle flange having at least one opening with an interior configuration; and d. at least one self-alignment mounting assembly including an eyelet placed through said at least one flange opening and mounted to said at least one panel, the eyelet having a portion with an exterior configuration similar to but smaller than said interior configuration of said at least one flange opening for maintaining a clearance therebetween;

e. whereby said at least one self-alignment mounting assembly provides a proper connection between said connector plug and said connector receptacle during misaligned engagement or separation where said plug shell and said receptacle shell are linearly or angularly shifted relative to each other.

16. The invention as defined in claim 15 wherein said interior configuration of said flange opening includes an interior conical surface and an interior cylindrical surface, and said exterior configuration of said eyelet includes an exterior conical surface and an exterior cylindrical surface.

17. The invention as defined in claim 15 wherein said at least one self-alignment mounting assembly further comprises means for providing a cushioning between said one of said plug flange and said receptacle flange and said eyelet.

18. The invention as defined in claim 17 wherein means for cushioning between said one of said plug flange and said receptacle flange and said eyelet includes an alignment spring.

19. The invention as defined in claim 15 further comprising an adjustable ejection assembly assembled in one of said plug shell and receptacle shell to apply an ejection force on another one of said plug shell and receptacle shell for minimum impulse separation.

20. The invention as defined in claim 19 wherein said adjustable ejection assembly includes at least one ejection spring for applying an ejection force to said other one of said plug shell and receptacle shell, and means for adjusting a pre-load of the ejection spring.

* * * * *